United States Patent [19]

Gravier

[11] Patent Number: 4,909,010

[45] Date of Patent: Mar. 20, 1990

[54] CONCRETE BLOCK FOR RETAINING WALLS

[75] Inventor: Robert A. Gravier, Bloomington, Minn.

[73] Assignee: Allan Block Corporation, Edina, Minn.

[21] Appl. No.: 134,104

[22] Filed: Dec. 17, 1987

[51] Int. Cl.[4] ..... E04C 1/12; E02B 3/12; E02D 17/20

[52] U.S. Cl. ..... 52/609; 405/284

[58] Field of Search ..... 52/604–611, 52/437, 596, 597; 405/273, 284–287

[56] References Cited

U.S. PATENT DOCUMENTS

| | | | |
|---|---|---|---|
| 1,508,325 | 9/1924 | Henderson | 52/437 |
| 2,313,363 | 3/1943 | Schmidt | 405/286 |
| 4,229,123 | 10/1980 | Heinzmann | 405/273 |
| 4,512,685 | 4/1985 | Hegle | 52/609 |

FOREIGN PATENT DOCUMENTS

| | | | |
|---|---|---|---|
| 844657 | 7/1981 | U.S.S.R. | 405/284 |

*Primary Examiner*—James L. Ridgill, Jr.
*Attorney, Agent, or Firm*—James R. Cwayna

[57] ABSTRACT

A concrete block particularly directed to the construction of retaining wall systems, characterized particularly by a step back frontal surface which includes a frontal surface having a flat decoratable portion over a substantial vertical dimension thereof and tapered rearwardly and vertically from such frontal surface to a top planar surface with an interlock area behind such surface to receive additional blocks thereon to create a wall. This interlock area provides a flat planar block locating surface for the positioning of a next vertical block and when the blocks are arranged in vertical relation on top of one another a step back frontal surface is provided. Combination drainage and tie-back anchor apertures are provided in the rear vertical surface of the block. The block includes weight reducing passages vertically therethrough which also accommodate vertical tiers. The block may include rearwardly and inwardly directed sides such that adjacent blocks are joinable to form a curved frontal surface of the constructed wall. The interlock of the blocks creates a strong barrier wall which affords an artistically conceived frontal surface. The design of the blocks provides for a vertical and horizontal tying of the blocks through reinforcing bars or other means.

9 Claims, 2 Drawing Sheets

FIG. 1
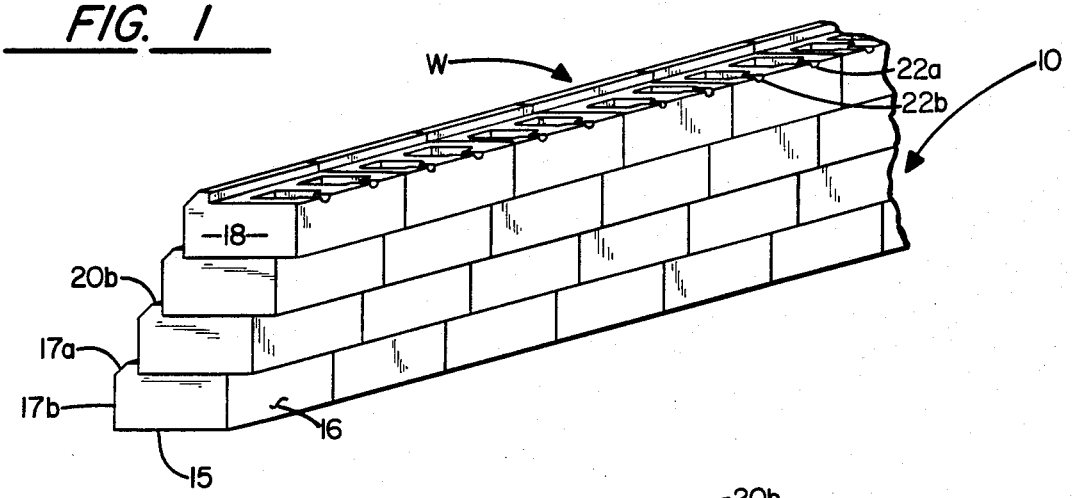
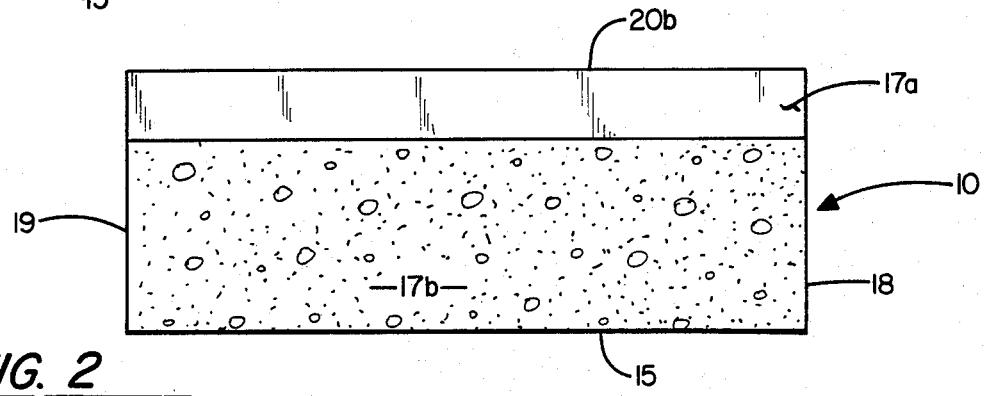
FIG. 2
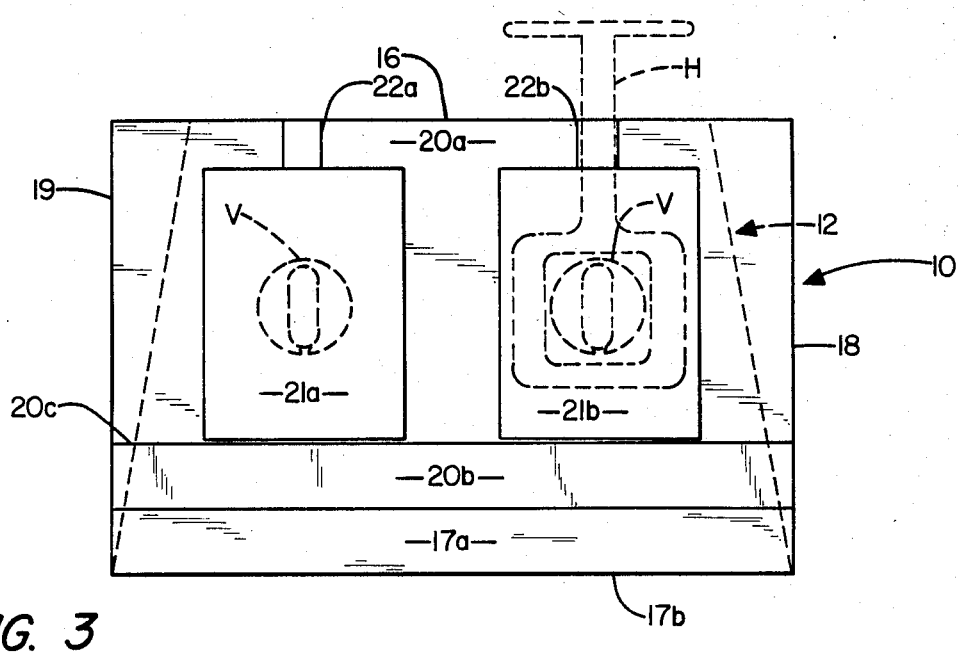
FIG. 3

CONCRETE BLOCK FOR RETAINING WALLS

FIELD OF THE INVENTION

This invention relates generally to concrete block structures and particularly to a concrete block joinder system for erection of retaining walls without mortar and which provides for an interlock of the blocks such that the resulting wall provides an inclined support and earth barrier.

SHORT SUMMARY OF THE INVENTION

This invention relates to a concrete block as the basis for a system for building of retaining walls and the like. The block is characterized by a generally flat rectangular surface for placement onto the ground or other bearing foundation and for placement onto lower blocks in erecting the wall. The block is further characterized by a frontal flat or decoratable surface having a rearwardly and upwardly directed upper portion terminating in a flat planar top with this frontal portion defining a rearwardly positioned notch and next block locating area. The upper surface of the block defines the locating portion as being a flat surface with a vertical ledge formed by a frontal, rearwardly directed portion such that blocks may be placed on top of one another and when so placed, an inclined front decorative surface is provided with an upper block interlocking with the next lower block. Applicant's block also incorporates weight reduction passages vertically therethrough which permit the insertion of vertical connecting rods between vertically adjacent tiers or rows of such blocks. In addition to the lightening apertures a rearwardly extending passage is formed through the rear vertical surface of the block to permit the installation of earth tie-bars into the block. The vertical and rearward connecting means may be combined. These rear apertures also serve as weep holes or drainage holes to permit water to drain from the interior of the block should water accumulate within the erected wall.

Applicant's block for a complete wall system may take several configurations with a first unit being a straight line block for the erection of straight walls with a second version providing rearwardly and inwardly directed sides such that adjacent blocks within any given row or tier, when abutted in side-by-side relation will form a curved surface to the frontal exposed wall area. Another version of the block includes corner elements where the inwardly and upwardly directed frontal surface is provided on at least the front and one adjacent side of the block. This version permits corner construction and continuance of the decorative front area about and around corners of various angles.

When completed, a retaining wall formed from the blocks embodying the applicant's concept provides an inclined frontal surface and an inclined rear surface matching the frontal surface with the frontal surface providing a decorative and artistic arrangement.

BACKGROUND AND OBJECTS OF THE INVENTION

Applicant is aware of many commercially available concrete blocks for the construction of retaining walls and the like. In reviewing the commercially available art he has not found any block which incorporates the advantages and interlocking abilities as contained herein.

Applicant has also searched the applicable patented art and has found the following listed U.S. Patents: Heinzmann, No. 4,229,123; Schmitt, No. 2,313,363; Clarke, No. 4,081,969; Fisher, No. 3,282,056; Upson, No. 982,697; and Perada, No. 4,426,176.

Of this prior patented art it would appear that only the Heinzmann and Schmitt patents include the concept of a seating and interlock area for the joinder and connection of vertically adjacent rows or tiers of blocks.

The Schmitt patent utilizes the interlocking edge on the rear downwardly depending corner of the blocks such that an upper block will have a downwardly depending side to abut against the top of a lower tier of blocks. This structure then provides a frontal surface which is entirely flat and which may be, as illustrated in Schmitt, decorated in various forms to similate brick or stone structures.

The Heinzmann patent illustrates a block to provide a support surface and a front locking surface for the next vertically adjacent row of blocks. The unit also provides for inversion of rows of blocks wherein this capturing lip or notch may be positioned in downwardly extending location over the rear of a lower tier of blocks. The Heinzmann patent does not consider frontal decorative situations and only provides a flat front surface which, when a wall is erected provides a series of straight, stepped elements. Heinzmann embraces the concept of "loose tiers" and strongly suggests horizontal spacing between tiers to allow for plant growth. Heinzmann does not allow for either vertical or horizontal tie-in and does not consider drainage from behind the wall and into the wall. Obviously, suitable material to sustain plant growth must be provided within the openings provided by the horizontal spacing of the blocks. This is a secondary operation. The final objective of the Heinzmann patent is to provide a "living wall" in direct controversy to the concept of the applicant's device.

None of these patents provide a decorative effect as obtained through the tapered, decoratable forward surface provided by applicant and none of these patents consider the utilization of tie bar accommodations such that the constructed wall may be tied both vertically and into the earth to be retained. In addition, none of these patents are concerned with the alleviation of water that may accumulate interiorly of the blocks.

It is therefore an object of the applicant's invention to provide a concrete retaining block unit for retaining walls which provides an interlock between vertically adjacent tiers of the blocks in constructing the wall.

It is a further object of the applicant's invention to provide a concrete block for the construction of retaining walls and the like which includes a frontal surface having an inwardly and upwardly directed portion at the upper edge of the frontal surface to provide a decorative frontal arc and having a flat receiving surface therebehind to receive the next vertically adjacent block thereon and interlock the same to provide a rearwardly directed and inclined frontal surface for the constructed wall.

It is a further object of the applicant's invention to provide an interlocking concrete block structure having weight reducing apertures arranged vertically therethrough which will also permit the passage of vertical tie bars between blocks and having a rear aperture therethrough designed for drainage of water from the interior of the blocks and also provide for a dual operation of tie bar installation wherein a tie bar may be inserted into the soil behind the wall and connect the wall thereto and further providing for interconnection of both tie bars.

It is a further object of the applicant's invention to provide a concrete block as the basis for a retaining wall system which includes a block specific to corner installation.

It is a further object of the applicant's invention to provide a method for manufacture of retaining wall blocks which includes molding of two blocks in face-to-face relation and splitting the blocks to provide a decorative surface to a front surface of the block.

SHORT DESCRIPTION OF THE DRAWINGS

FIG. 1 is a perspective view taken from the rear side of a retaining wall constructed from concrete blocks embodying the concepts of the applicant's invention;

FIG. 2 is a front elevation view of the blocks;

FIG. 3 is a top plan view of the blocks, including, in phantom lines, a horizontal and a vertical tie back;

DESCRIPTION OF A PREFERRED FORM OF THE INVENTION

Figure 7:
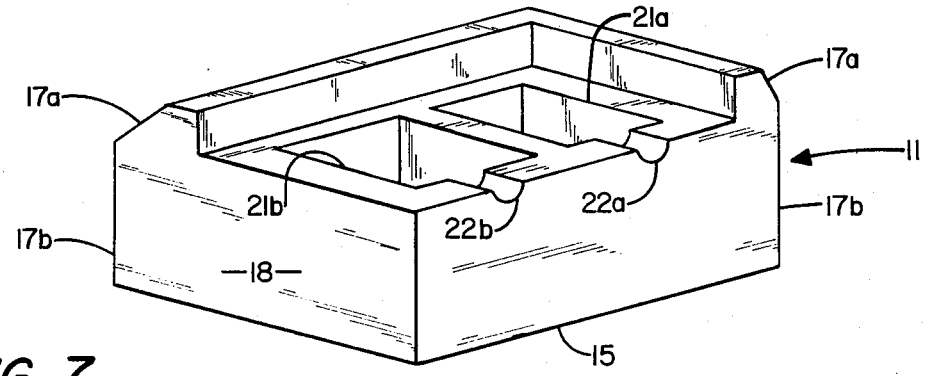
FIG. 7 is a rear perspective view of a block embodying the applicant's concepts and provided for corner installation.

In accordance with the accompanying drawings the concrete block as the basis for a retaining wall system embodying the concepts of the applicant's invention is generally designated 10. A modified form of the block particularly adapting the same for corner installations is generally designated 11 as illustrated in FIG. 7 and this form will be described after the description of the first, what may be termed straight line form of the invention. Another modification of the block 10 is shown by the dotted line configuration of FIG. 3 and this form will be described hereinafter and is designated 12.

A typical wall section as constructed from a plurality of the straight line blocks 10 is illustrated in FIG. 1. The wall W, as illustrated in FIG. 1, shows the interlocking arrangement for the blocks 10 particularly to show the inclined frontal surface and inclined rearward surface of the completed wall W.

Figure 4:
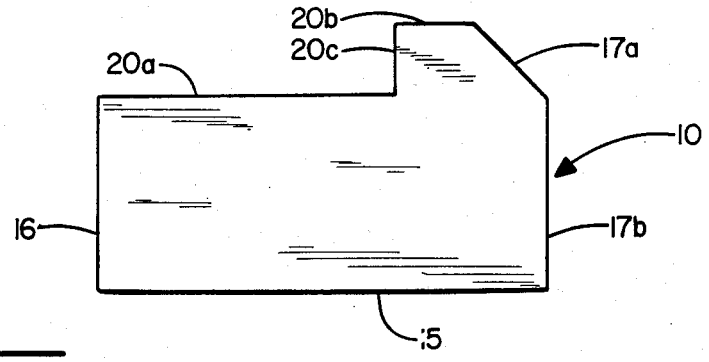
FIG. 4 is a side elevation thereof.
Figure 5:
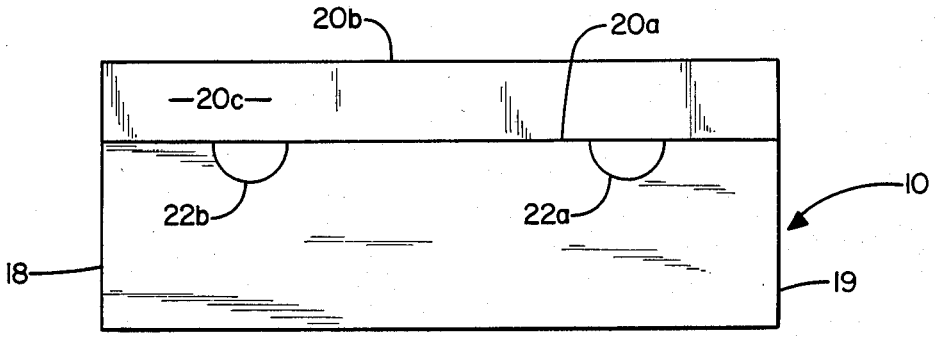
FIG. 5 is a rear elevation thereof.
Figure 6:
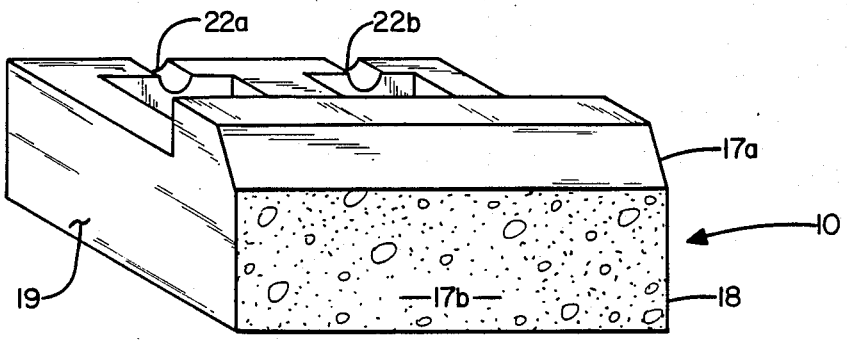
FIG. 6 is a front perspective of the applicant's block.

The block 10 is generally rectangular in shape and of a predetermined height and, as best illustrated in the side elevation of FIG. 4 includes a bottom surface 15, a rear side 16, a frontal surface consisting of a rearwardly and upwardly directed portion **17*a* and a vertical portion 17*b* and end surfaces 18–19 in normal arrangement to the frontal surface 17*b* or which may be angularly arranged thereto as will be further described with consideration of form 12. The uppermost surface of all forms of the block 10, 11 and 12 is divided into two distinct areas designated respectively 20*a*–20*b* with a vertical dividing shoulder 20*c* arranged therebetween. The area defined by a flat top surface 20*a* with vertical shoulder 20*c*** provides an interlock area for the next vertically oriented block received thereon.

As particularly illustrated in FIG. 3 lightening or weight reduction passages **21*a*–21*b* are provided vertically through the block 10 and a pair of apertures or passages 22*a*–22*b* communicate with such passages 21*a*–21*b* through surface 20*a* to define a passage from the weight reducing areas 21*a*–21*b* through the rearmost surface 16 of the block. The block 10 then provides a primary support base 15 which is positioned on the ground or other foundation surface with the next vertically oriented tier of blocks being arranged in the interlocking area formed by the surfaces of the top 20*a*, 20*b* and 20*c*. In this particular arrangement it should be obvious that the weight reducing passages 21*a*–21*b* of several vertically oriented blocks will be in general alignment for either filling of the same with dirt or other materials or for the insertion of vertical tie elements such as re-bars or the like. These apertures 21*a*–21*b*** then perform a dual function in initial weight reduction of the block for ease of handling thereof and ultimate filling thereof or tying of vertically oriented blocks to one another.

Apertures **22*a*–22*b* passing from the weight reducing passages 21*a*–21*b* through the rear surface of the block serve a dual function. These apertures or passages or channels 22*a*–22*b* serve as fluid or water relief holes for the drainage of any accumulated water from the interior of the formed wall into the adjoining dirt or alternatively form a channel into which an anchor may be placed for tying the entire formed wall into the adjoining dirt which is to be retained. Such tie-bars are normally referred to as dead heads and many forms of anchoring devices are available and the channels 22*a*–22*b*** accommodate the various tie in units.

FIG. 3 illustrates the utilization of vertical V and horizontal H tie bars which aid in maintaining vertical alignment of the blocks 10 and tie-in of the completed wall system into the earth to be retained. These articles V, H are illustrated in phantom lines as being suggestive of tie-in utilization. As illustrated in FIG. 3, a vertical tie bar V may pass through aligned apertures **21*a*–21*b* of the block 10 or, as illustrated in the right aperture 21*b* of the block 10 the vertical V tie bars may be interconnected with a horizontal H tie bar with the tie bar H having a receiving aperture formed on one end thereof. Such tie bars are readily available in the art. In the combinative effect as illustrated in the passage 21*b* the vertical tie V passes through the aperture in the horizontal tie H for the desired combined vertical and horizontal tie situation. Obviously the horizontal tie H may take many forms and is commonly known as a "dead head" member. This particular combinative useage is only available with a block having the vertical passages 21*a*–21*b* and the combined drainage tie bar passages 22*a*–22*b***.

The frontal surface 17 of the block, consisting of the upwardly and rearwardly defined surface **17*a* and vertical surface 17*b* provides a decorative effect to the block and further reduces the possible area of accumulation of material on the frontal and upper surface of the block. In the prior art situations blocks that provide such an upper interlock surface also provide a flat ledge upon which debris, dirt, water and the like may accumulate. By providing the sloped surface 17*a*** a more pleasing decorative effect is obtained and the accumulation area is substantially decreased.

Applicant's method of molding the individual blocks 10 results in a new method of manufacture to obtain a particular decorative surface on the vertical section **17*b* of the frontal area 17 of the block 10. Two blocks are molded as a single unit with the surfaces 17*b* being formed after molding. Obviously in a molded two part unit the tapered surfaces 17*a* of two facing blocks provides a "splitting" channel. Simply cracking the blocks along the meeting surfaces of the tapered portion 17*a*** results in the blocks splitting to form surface 17*b*. The result of such splitting will provide an open aggregate surface and thus a decorative surface for each of the molded blocks. It is felt that this method for providing the frontal decorative surface is unique in the art as most exposed aggregate surfaces are obtained either through sandblasting or exposed aggregate molding techniques.

It should be obvious that a retaining wall utilizing a straight line block simply requires the forming of a foundation surface for the lower block and placing the blocks in a single tier in a side by side relation with the next tier of blocks being positioned in the receiving notch area of the block 10.

In order to form a curved front surface the sides 18–19 may be directed to converge inwardly as illustrated by the dotted line configuration, designated 12 in FIG. 3. Obviously this same modification could be provided to include sides 18–19 which would converge in a forward direction such that curvalinear effects of both convex and concave design would be attainable. This requires a slight modification from the normal side elements in the straight line arrangement.

A further modification of the applicant's unit is designated 11 and illustrated in FIG. 7. In this form of the invention the frontal beveled surface 17*a* is provided on two surfaces of the block such that a corner effect is attained. As illustrated in FIG. 7, on such a block, there are two frontal vertical surfaces 17*b* arranged at right or a selected angle to each other with the inwardly directed surfaces 17*a* accommodating this same angularity. Obviously this corner configuration could be provided for both a right and left hand corner.

It should be obvious that the applicant's block has certain unique features and serves as an element in a system for the construction of retaining walls. The straight line configuration permits simple straight walls with the combination of the corner elements permitting continuation of the wall about corners while the converging and diverging side structures permit the construction of curvalinear walls. The tie, both vertical and horizontal, provide for positive joinder of the blocks 10 not only to one another but also to the earth to be retained. The combinative effect of the vertical and horizontal ties offers a very positive method for vertical and horizontal tying of a completed wall. The horizontal channels through the rear of the blocks 10 into the vertical passages of the blocks provides means for draining water from the retained earth. The cause of wall collapse is very often the accumulation of water behind the wall and with this structure drainage of such water is achieved.

Use of the applicant's block should be obvious and the interlocking, interconnecting thereof should similarly be obvious. The various dimensions of the block may be modified to any configuration without departing from the scope of the invention.

What I claim is:

1. A concrete block for use in construction of retaining walls and the like, said block including:

a. bottom, top, rear, side and frontal surfaces, b. said bottom, rear and side surfaces being generally planar and arranged generally normal to one another;

c. said top including a first support area defined over a predetermined area of said top for the support of additional blocks, a vertically extending shoulder adjacent said frontal surface of said block and extending entirely therealong to provide a continuous block positioning member in close association to said frontal surface and a second top surface at the uppermost end of said extending shoulder;

d. said frontal surface defining a lower vertical portion normal to said bottom and an upper, rearwardly inclined portion extending from said vertical portion terminating at said second top surface;

e. said support area and said vertical shoulder providing a locating surface to receive an additional vertically positioned block thereon wherein the additional block is positioned rearwardly from the front surface of the receiving and supporting block whereby a wall of tiers of such blocks extend rearwardly and upwardly from a support surface.

2. The block structure as set forth in claim 1 and said side surfaces being inwardly and rearwardly directed with respect to said frontal surface whereby joined adjacent blocks will effect a generally curved surface to a formed retaining wall.

3. The block structure as set forth in claim 1 and said side surfaces being outwardly and rearwardly directed with respect to said frontal surface whereby joined adjacent blocks will effect a generally curved surface to a formed retaining wall.

4. The block structure as set forth in claim 1 and, a. said top including a second vertically extending shoulder adjacent one of said side surfaces of said block and in general horizontal alignment with and normal to said vertically extending shoulder adjacent said frontal surface of said block and said second to p surface extending thereover; and, b. one of said side surfaces defining a lower vertical portion normal to said bottom and an upper, rearwardly inclined portion extending from said vertical portion terminating at said second top surface whereby the block provides a corner structure with an upper block locating surface and a continuous sloped frontal surface configuration.

5. The block structure as set forth in claim 1 and at least one vertical aperture provided to extend from said first support area of said top surface to said bottom surface thereof for weight reduction of the block during construction and filling and block connection means following construction of a retaining wall, said vertical shoulder positioned with respect to said aperture whereby said additional block positioned against said vertical shoulder will cover the aperture in the block thereunder.

6. The block structure as set forth in claim 5 and channel means formed in said top support area of said block extending from said aperture through said back surface thereof for placement of earth connecting means therein whereby the constructed wall may be tied to the earth to be retained.

7. The block structure as set forth in claim 5 and a pair of vertical apertures being provided in side-by-side relation through said block.

8. The block structure as set forth in claim 7 and a channel means formed in said top support area of said block extending from each of said apertures through said back surface thereof for placement of earth connecting means therein whereby the constructed wall may be tied to the earth to be retained.

9. The block structure as set forth in claim 8 and:

a. said channel means communicating with said vertical apertures.

* * * * *